US008316594B2

(12) United States Patent
Thompson

(10) Patent No.: US 8,316,594 B2
(45) Date of Patent: Nov. 27, 2012

(54) STAIR TREAD ASSEMBLY AND METHOD

(75) Inventor: Marianne Thompson, Waterloo (CA)

(73) Assignee: Moulure Alexandria Moulding Inc. (CA)

( * ) Notice: Subject to any disclaimer, the term of this patent is extended or adjusted under 35 U.S.C. 154(b) by 0 days.

(21) Appl. No.: 12/575,288

(22) Filed: Oct. 7, 2009

(65) Prior Publication Data

US 2011/0179729 A1 Jul. 28, 2011

(51) Int. Cl.
*E04F 11/16* (2006.01)
*E04F 11/104* (2006.01)

(52) U.S. Cl. ..... 52/179; 52/182; 52/578

(58) Field of Classification Search ..... 52/177, 52/179, 180, 181, 182, 183, 184, 185, 186, 52/187, 188, 189, 190, 191, 578, 582.1, 592.2
See application file for complete search history.

(56) References Cited

U.S. PATENT DOCUMENTS

| | | | | | |
|---|---|---|---|---|---|
| 381,407 | A | * | 4/1888 | Momberg | 52/188 |
| 603,130 | A | | 4/1898 | De Man | |
| 844,408 | A | * | 2/1907 | Schachner | 52/188 |
| 2,200,650 | A | | 5/1940 | Welch | |
| 2,205,044 | A | | 6/1940 | Moore | |
| 2,288,470 | A | | 6/1942 | Lorraine | |
| 2,847,732 | A | | 8/1958 | Hyman | |
| 3,074,448 | A | | 1/1963 | Brown | |
| 3,168,763 | A | | 2/1965 | Gilbert | |
| 3,287,867 | A | | 11/1966 | Aton | |
| 3,393,481 | A | | 7/1968 | Meuret | |
| 3,438,840 | A | | 4/1969 | George | |
| 3,445,325 | A | | 5/1969 | Clark | |
| 3,866,268 | A | * | 2/1975 | Cormier | 16/10 |
| 3,969,558 | A | * | 7/1976 | Sadashige | 428/58 |
| 4,037,374 | A | | 7/1977 | Balzer | 52/179 |
| 4,210,692 | A | * | 7/1980 | Bohme et al. | 428/106 |
| 4,730,425 | A | | 3/1988 | Young | 52/182 |
| 4,783,939 | A | * | 11/1988 | Bergmann et al. | 52/188 |
| 5,059,472 | A | * | 10/1991 | Le Bell et al. | 428/161 |
| 5,074,092 | A | | 12/1991 | Norlander | 52/455 |
| 5,088,247 | A | | 2/1992 | Young | 52/182 |
| 5,109,898 | A | * | 5/1992 | Schacht | 144/350 |
| 5,167,102 | A | * | 12/1992 | Nakatsubo et al. | 52/188 |
| 5,253,932 | A | | 10/1993 | Nesovic | 312/140.3 |
| 5,357,724 | A | | 10/1994 | Sonoda | 52/182 |
| 5,386,673 | A | | 2/1995 | Bellegarde | 52/182 |

(Continued)

FOREIGN PATENT DOCUMENTS

CA 2442196 7/2007

(Continued)

*Primary Examiner* — Basil Katcheves
*Assistant Examiner* — Rodney Mintz
(74) *Attorney, Agent, or Firm* — Ostrolenk Faber LLP

(57) ABSTRACT

A replacement or repair stair tread assembly for covering over an existing worn stair tread includes a core that is surrounded by hardwood edge members, of which at least on edge has a bullnose. The edge members and core are mated at tongue and groove joints. The bullnose has a greater depth of section than the core. The core is a multi-ply matrix with veneer surface skins of the same grain orientation and type of wood. The multiple plies are arranged such that successive layers have cross-wise grain orientation. The plies of the core have symmetrically balanced properties relative to the neutral axis or neutral plane of the core in bending, both cross-wise and length-wise. The balanced properties may pertain to water absorption and to resistance to bending.

14 Claims, 3 Drawing Sheets

U.S. PATENT DOCUMENTS

Figures 1A, 1B, 1C, 1D:
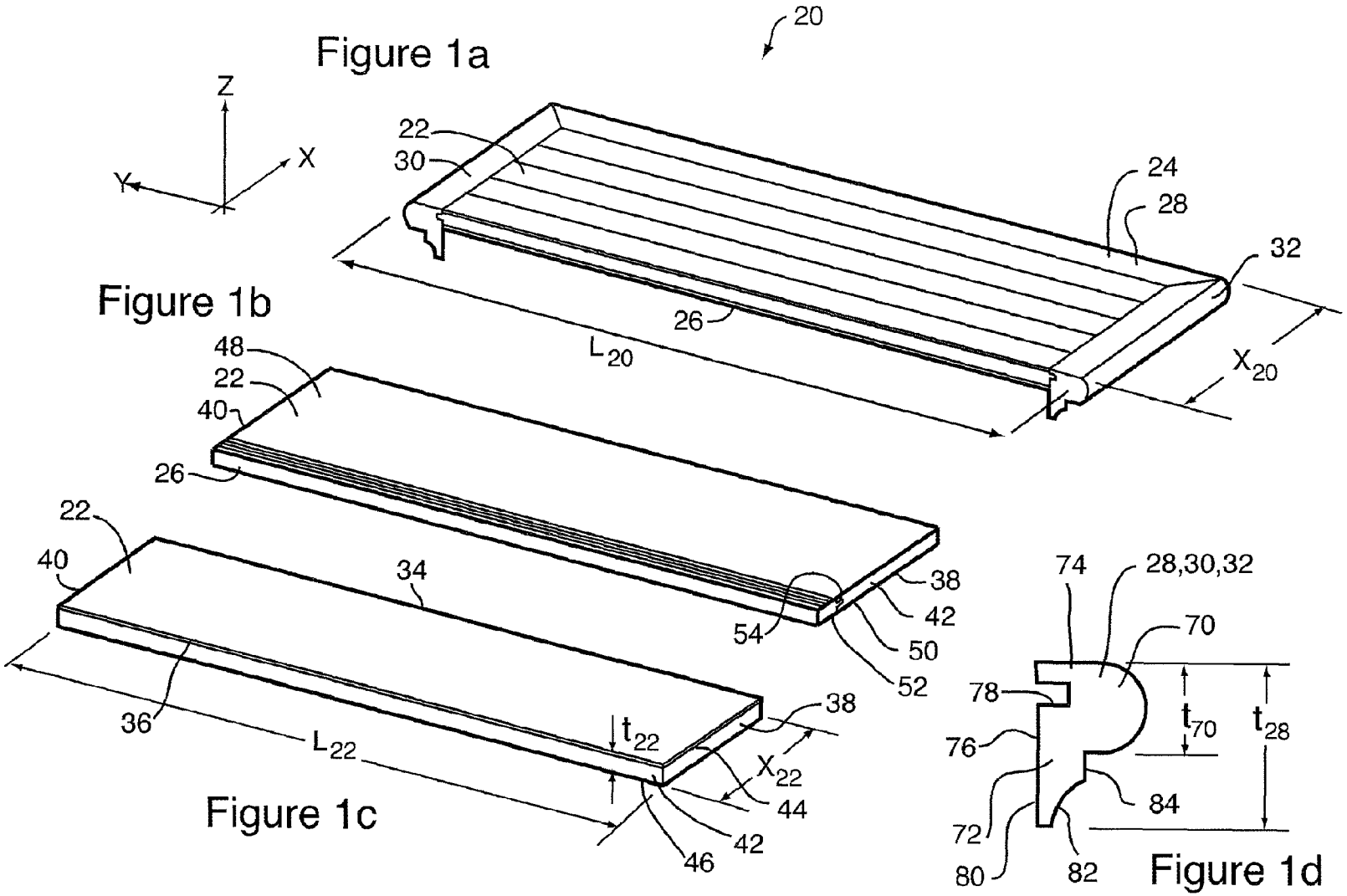

| | | | | |
|---|---|---|---|---|
| 5,713,166 | A * | 2/1998 | Couture | 52/191 |
| 5,806,253 | A | 9/1998 | Nelson | 52/179 |
| 5,985,398 | A | 11/1999 | Bellegarde | 428/54 |
| 6,021,615 | A * | 2/2000 | Brown | 52/392 |
| 6,023,900 | A * | 2/2000 | Stoehr et al. | 52/403.1 |
| 6,025,053 | A | 2/2000 | Grenier | 428/172 |
| 6,067,758 | A * | 5/2000 | Zenkner | 52/182 |
| 6,073,408 | A * | 6/2000 | Winer et al. | 52/385 |
| 6,115,975 | A | 9/2000 | Abdollahi | 52/179 |
| 6,173,540 | B1 | 1/2001 | Spivey | 52/191 |
| 6,324,809 | B1 * | 12/2001 | Nelson | 52/592.2 |
| 6,345,481 | B1 * | 2/2002 | Nelson | 52/592.2 |
| 6,397,529 | B1 | 6/2002 | Grenier | 52/182 |
| 6,427,408 | B1 * | 8/2002 | Krieger | 52/489.1 |
| 6,596,362 | B1 | 7/2003 | Chung | 428/55 |
| 6,665,987 | B2 | 12/2003 | Eve | 52/182 |
| 6,701,984 | B2 * | 3/2004 | Lamontagne et al. | 144/347 |
| 6,824,851 | B1 | 11/2004 | Locher | 428/76 |
| 6,860,071 | B2 | 3/2005 | Weaber | 52/179 |
| 6,895,717 | B1 | 5/2005 | Grinstead | 52/182 |
| 6,920,725 | B2 | 7/2005 | Lanphier | 52/182 |
| 6,960,273 | B2 * | 11/2005 | Jung | 156/98 |
| 7,073,297 | B2 | 7/2006 | Grinstead | 52/182 |
| 7,464,505 | B2 | 12/2008 | Grenier | 52/179 |
| 7,854,098 | B2 * | 12/2010 | Stanhope | 52/309.3 |
| 8,141,321 | B2 * | 3/2012 | Young | 52/741.2 |
| 2003/0012970 | A1 | 1/2003 | Auclair | 428/537.1 |
| 2003/0143361 | A1 * | 7/2003 | Chung | 428/56 |
| 2003/0182880 | A1 * | 10/2003 | Weaber et al. | 52/179 |
| 2006/0123731 | A1 * | 6/2006 | Eisermann | 52/582.1 |
| 2006/0196129 | A1 | 9/2006 | Lin | 52/188 |
| 2006/0260224 | A1 * | 11/2006 | Grenier | 52/182 |
| 2007/0028534 | A1 | 2/2007 | Defehr | 52/179 |
| 2007/0062153 | A1 * | 3/2007 | Li et al. | 52/796.1 |
| 2008/0028699 | A1 | 2/2008 | Mak | 52/179 |
| 2008/0216421 | A1 * | 9/2008 | Chung et al. | 52/179 |
| 2008/0216422 | A1 * | 9/2008 | Chung et al. | 52/188 |
| 2008/0271390 | A1 | 11/2008 | Lopez | 52/177 |
| 2008/0295422 | A1 * | 12/2008 | Neuhofer, Jr. | 52/179 |
| 2009/0193741 | A1 * | 8/2009 | Cappelle | 52/309.1 |
| 2009/0235594 | A1 * | 9/2009 | Won | 52/179 |
| 2009/0277104 | A1 * | 11/2009 | McCool | 52/179 |
| 2010/0281796 | A1 * | 11/2010 | Kennedy | 52/182 |
| 2010/0287853 | A1 | 11/2010 | Chung | 52/179 |
| 2010/0300030 | A1 * | 12/2010 | Pervan et al. | 52/588.1 |
| 2011/0131902 | A1 * | 6/2011 | Young | 52/179 |
| 2011/0146168 | A1 * | 6/2011 | van Genderen | 52/179 |
| 2011/0162302 | A1 * | 7/2011 | Barrett | 52/179 |
| 2011/0252725 | A1 * | 10/2011 | Glorgio | 52/177 |
| 2012/0102855 | A1 * | 5/2012 | Epple | 52/184 |

FOREIGN PATENT DOCUMENTS

| | | |
|---|---|---|
| DE | 202004009211 | 11/2004 |
| EP | 496914 | 10/1993 |
| JP | 10-227113 | 8/1998 |
| JP | 2001-98729 | 4/2001 |
| JP | 2002-227366 | 8/2002 |

* cited by examiner 20
24
28
32
$X_{20}$
26
$L_{20}$
22
30

Z
X
Y
38
42
50
52
54
48
22
40
26

38
$X_{22}$
44
42
46
$t_{22}$
34
$L_{22}$
36
22
40

28,30,32
70
$t_{28}$
$t_{70}$
84
74
82
78
76
72
80

STAIR TREAD ASSEMBLY AND METHOD

FIELD OF INVENTION

This application relates to a stair tread assembly, such as may sometimes be referred to as a "false tread", and to a method for renovating a stair tread.

BACKGROUND OF THE INVENTION

It is well known that stair treads may wear out. Rather than replacing an entire staircase, or going to the significant trouble of removing the existing worn tread to permit complete replacement, it is also known to cover over the treads of a worn staircase with a new material, whether in the nature of a carpet, such as a stair runner, or a new surface. The new surface is often termed a "false tread", namely a new tread that covers over an existing worn tread. An example of a false tread apparatus is shown in US patent publication US 2008/0271390 of Lopez, published Nov. 6, 2008.

SUMMARY OF INVENTION

In an aspect of the invention there is a stair tread assembly. It has a core member. The core member has a thickness, a step-wise depth, and a cross-wise width. The step-wise depth and the cross-wise width is greater than the thickness. The core member has a wood-based core matrix. The core matrix has a plurality of overlying layers. The matrix has substantially uniform properties of mechanical elasticity cross-wise, and having substantially uniform properties of mechanical elasticity stepwise. The matrix has an upper surface and an opposed lower surface. The core includes at least a first wood veneer portion mounted to the upper surface of the core matrix, and a second wood veneer portion mounted to the lower surface of the core matrix, the first and second wood veneer portions lying in parallel planes. The core member has a quadrilateral form when viewed looking in a direction perpendicular to the plane of the first wood veneer portion. The core member has a periphery and an array of edge members mounted thereto about the periphery such that the core matrix is concealed from view. The edge members are made of solid hardwood. The edge members include at least a first nosed edge member. The edge members include at least a first un-nosed edge member. The core has a first edge portion for mating engagement with the first un-nosed edge member. The first edge portion has a first profile machined along at least a first portion thereof. The first un-nosed edge member having a second profile machined therealong. The first and second profiles include out-of-plane features. The first and second profiles are mutually mating profiles. The first un-nosed edge member has a through thickness matching the core such that when the first and second profiles are mated the first un-nosed edge member mates flush with the first wood veneer portion of the core. The core has a second edge portion for mating engagement with the first nosed edge member. The second edge portion has a third profile. The first nosed edge member has a fourth profile machined therealong. The third and fourth profiles are mutually mating profiles such that when mated together the first nosing is flush with the first wood veneer portion of the core. The nosing has an overall height greater than the thickness of the core.

In another feature of that aspect of the invention the first nosed edge portion is oriented cross-wise to the first un-nosed edge portion. The first un-nosed edge portion has a first end. The third profile is cut across the first end of the first un-nosed portion. The first nosed edge portion has an end region mated to the first end of the first un-nosed edge portion. In still another feature, the first nosing edge member includes a bullnose, and the bullnose has a through thickness greater than the thickness of the core. In still another feature the first nosing edge member includes a depending edge located stepwise inwardly of the bullnose, and the depending edge has a rearward facing abutment surface for engaging an existing stair. In still another feature the stair tread includes four edge members in a set, the set including any one of: first, second and third nosed edge members and the first un-nosed edge member; first and second nosed edge members and first and second un-nosed edge members; and the first nosed edge member and first, second and third un-nosed edge members.

In still another feature, the core matrix is a plywood matrix. In a further feature (a) red oak; (b) white oak; (c) maple; (d) walnut; and (e) cherry. In still another feature the core has a through thickness of less than ¾ inches. In yet another feature the first nosed edge member includes a bullnose, and the bullnose has a through thickness of at least 1 inch. In still yet another feature the core is substantially rectangular and has a pair of long edges and a pair of short edges. The first un-nosed edge extends along one of the long edges. When assembled, the core and the first un-nosed edge, taken together, have an overall dimension step-wise of at least 7½". In a still further feature the bullnose has a depending flange. The depending flange has a rearwardly facing abutment surface for engagement of an existing stair, the rearwardly facing abutment surface extending in a plane flush with a forward edge of the first wood veneer portion. In still yet another further feature the first profile is a tongue and the second profile is a mating groove. In still another feature the third profile is a tongue and the fourth profile is a mating groove. In another feature the first and third profiles are the same, and the second and fourth profiles are the same.

In another aspect of the invention, there is a replacement stair tread assembly for covering over an exiting stair tread. The replacement stair tread assembly has a core having a periphery including a stepwise leading edge, a stepwise trailing edge, and first and second cross-wise end edges. The core has matched hardwood upper and lower surface layers. There are edge members that extend fully about the periphery of the core. The edge members include at least a first nosed edge member mounted along the stepwise leading edge. The core and edge members have interlocking profiles that are mate together. The core has a neutral axis. The core has multiple layers with cross-wise variation of grain direction between successive layers. The core has a cross-section that is matched above and below the neutral axis. In a further feature the core has a cross-wise length and a stepwise tread distance, and a ratio of the length to tread distance that is greater than 36:9½.

In still another aspect of the invention there is a replacement stair tread assembly for covering over an exiting stair tread. The replacement stair tread assembly has a full width core having a periphery including a stepwise leading edge, a stepwise trailing edge, and first and second cross-wise end edges. The full width core has a cross-wise length of at least than 30 inches. There are edge members extending fully about the periphery of the core. The edge members include at least a first nosed edge member mounted along the stepwise leading edge. The core and edge members have interlocking profiles that are mate together. The core has a neutral axis. The core has multiple full width layers with cross-wise variation of grain direction between successive layers. The core has a cross-section that has substantially matched physical properties above and below the neutral axis.

In another feature of that aspect of the invention the substantially matched physical properties include moisture absorption. In still another feature the substantially matched physical properties include resistance to out of plane bending in both cross-wise and step-wise orientation.

BRIEF DESCRIPTION OF THE ILLUSTRATIONS

The invention may be explained with the aid of the accompanying illustrations, in which:

FIG. 1*a* is a general arrangement isometric view taken from behind, above and to the right hand side of an embodiment of a stair tread assembly according to an aspect of the present invention;

FIG. 1*b* shows an isometric view of a sub-assembly the stair tread assembly of FIG. 1*a* prior to machining;

FIG. 1*c* shows an isometric view of a core of the sub-assembly of FIG. 1*b* prior to machining;

FIG. 1*d* shows an enlargement of a profile of an edge member of the stair tread assembly of FIG. 1*a;*

Figures 2A, 2B, 2C:
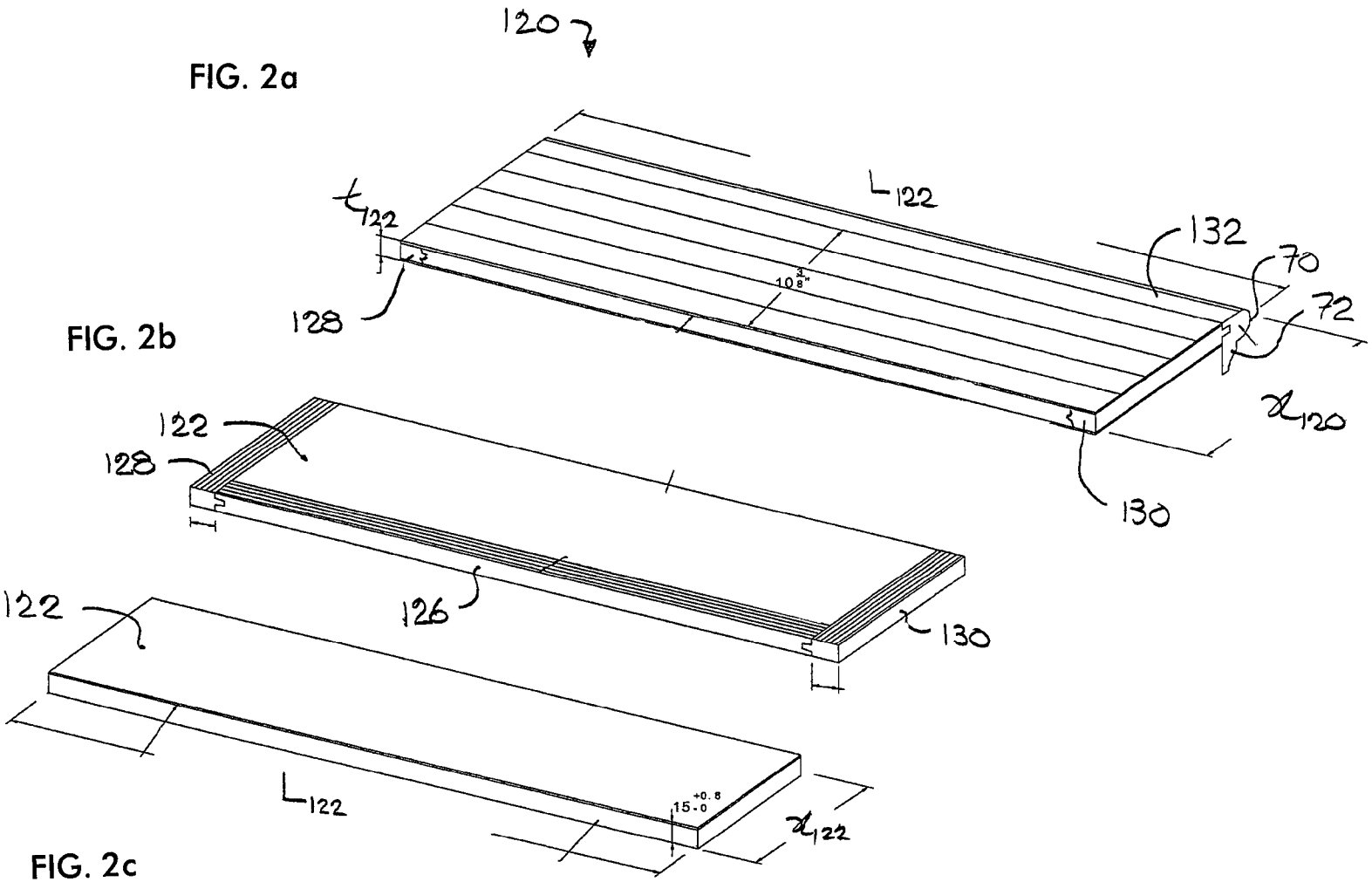
Figure 3:
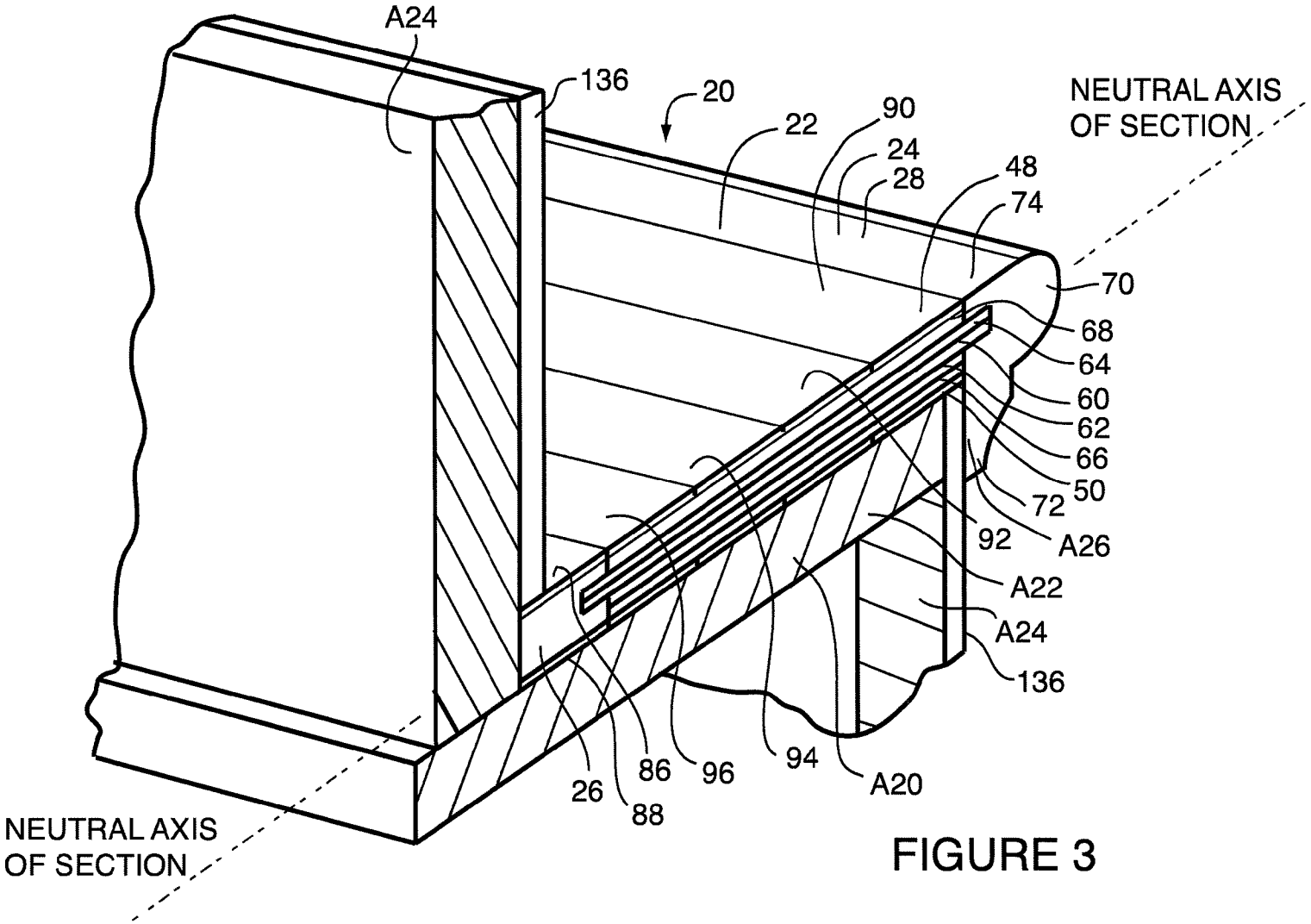

FIG. 2*a* is a general arrangement isometric view taken from behind, above and to the right hand side of an embodiment of a stair tread assembly according to an aspect of the present invention;

FIG. 2*b* shows an isometric view of a sub-assembly the stair tread assembly of FIG. 2*a* prior to machining;

FIG. 2*c* shows an isometric view of a core of the sub-assembly of FIG. 2*b* prior to machining; and FIG. 3 is a cut-away perspective view of a false tread installation employing the assemblies of FIGS. 1*a* and 2*a*.

DETAILED DESCRIPTION

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated, more clearly to depict certain features of the invention.

The inventor seeks a fair and reasonable interpretation of the claims, and of this specification. The terminology used in this specification is thought to be consistent with the customary and ordinary meanings of those terms as they would be understood by a person of ordinary skill in the art in North America. Following from the decision of the Court of Appeal for the Federal Circuit in *Phillips v. AWH Corp.*, the Applicant expressly excludes all interpretations that are inconsistent with this specification, and, in particular, expressly excludes any interpretation of the claims or the language used in this specification such as may be made in the USPTO, or in any other Patent Office, unless in some way supported by the specification or by objective evidence of record in accordance with In re Lee, (for example, earlier publications by persons not employed by the USPTO or any other Patent Office), demonstrating how the terms are used and understood by persons of ordinary skill in the art, or by way of expert evidence of a person or persons of experience in the art.

The current invention pertains to stair treads. In that context it may help to define a frame of reference or co-ordinate system. While stairs may be built on curves, such as circular staircases, they are most commonly rectangular. In that context a Cartesian co-ordinate system may be used in which the x-direction is the step-wise direction from the back of the step at the riser to the front of the step at the nosing, in the direction in which a person climbs or descend the stair. The y-direction is the cross-wise direction of the stair, the x and y directions tending then to define a plane, that plane being, or being parallel to, the plane of the surface of the face of the tread on which a person may step. The z-direction is then the through thickness or vertical direction as installed. Although the description is made in a Cartesian context, it is intended to be generic such that it is also applicable to non-rectangular stair treads.

In a typical step the stepwise extent of the tread, $x_{20}$, may most often be about 9½-11 inches, the cross-wise extent, $L_{20}$ may commonly be 30, 32, 36, 42 or 48 inches, and the thickness may be less than 2 inches, typically about or slightly less than 1 inch. A common existing step tread size is about 10¼ to 10½". That is, the stair is typically several times as large in the cross-wise direction as the step-wise direction, and is much smaller, typically an order of magnitude smaller, in the thickness direction.

FIG. 1*a* shows an embodiment of a false tread assembly, which may also be termed a replacement tread assembly, indicated generally as 20, falling within an aspect of the present invention. The assembly has a core 22. An array or set of edge members 24 is mounted about the periphery of core 22. That set may include an un-nosed edge member 26, and first, second and third nosed edge members 28, 30, 32. Core 22 is a substantially planar member having a breadth $L_{22}$, a depth $x_{22}$, and a thickness $t_{22}$. By the co-ordinate system identified above, the breadth is in the cross-wise or y-direction, the depth is in the step-wise or x-direction, and the thickness is in the vertical or z-direction. Core 22 is a quadrilateral, which may be a rectangle having two long sides 34, 36, and two short sides, 38, 40. Un-nosed edge member 26 lies along a rearward or step-wise inward or long edge 36 of core 22, first nosed edge member 28 lies along the step-wise forward or opposite long edge 34, and the second and third nosed edge members 30, 32 lie along the short sides 38, 40 of core 22. Core 22 includes an internal matrix 42 that has an upper surface 44 and a lower surface 46. A first sheet of veneer 48 is mounted to upper surface 44, and a second sheet of veneer 50 is mounted to lower surface 46. Thus all sides of core 22 are covered, i.e., they are hidden from view, concealed, no longer externally visible, however expressed.

In the past, false treads have been known where the false tread came in two parts, those parts being installed in cross-wise spaced apart relationship, for covering the lateral edges of the step, with, for example, a carpet runner arranged to run between those end parts.

Replacement tread assembly 20 is a full width replacement tread. It is intended to span the full width of the underlying worn step, without the need for an intermediate carpet runner or similar device for covering the worn center section of the step. Of course, this does not preclude the possibility that someone might still wish to place a carpet runner over a full width tread, but that is an option, rather than a requirement. For the purposes of this specification, the term "full width", $L_{20}$ means a tread that is wider than 24", most commonly expected to be 32" or wider, and in other embodiments it is 42" or 48" wide, respectively. That is, it is not merely one half of a two part matched pair of end portions.

Core 22 has a profile 52 formed on each of its edges, in this case each of its four edges, for engagement with a mating profile 54 formed on the corresponding nosed or un-nosed edge member, as may be. These profiles are out-of-plane profiles. That is, rather than merely employing a planar abutment face, which would extend typically in a vertical horizontal plane, the profiles are in the nature of mating finger-groove or male-and-female tongue and groove profiles that depart from, for example, a purely planar surface. While each edge member 26, 28, 30, 32 may have its own particular, different profile, it is convenient that those profiles be the same.

Internal matrix 42 is a dimensionally stabilized member having mechanical stress field reaction properties that are substantially uniform in the step-wise or x-direction, and that are substantially uniform in the cross-wise or y-direction. In this specification, the term "dimensionally stabilized" means an element that has criss-crossed layers of wood fiber materials assembled or bonded together such that the end product is planar and of a substantially uniform moisture content, that has balanced wood layers above and below the neutral axis in both the x and y directions such that the core may tend to be less prone than solid wood to out-of plane deflection due to a change in humidity than it might otherwise be if it were made of, for example, a solid piece of wood. The multilayer construction is used in distinction to the multiple solid block construction, whether sandwiched between veneer or otherwise, as shown and described variously in U.S. Pat. No. 6,860,071 of Weaber et al.; US Publication 2006/0196129 of Lin; and US Publication 2008/0028699 of Mak.

Internal matrix 42 is assembled from an array of plies or wood, each ply having a predominant grain direction, the grain of each successive ply being oriented in a different direction from the next adjacent ply in the direction moving away from the neutral axis of the section. Most typically that difference in orientation approximates very nearly, or is, a right angle (i.e., 90 degree) difference in orientation. That is, matrix 42 is assumed to be substantially planar, and to have a neutral plane, referred to when viewed in cross-section as the "neutral axis", in bending. The structure of the assembled layers of matrix 42 is substantially symmetrical about the neutral axis. In practice this may tend to mean that whatever the thickness of the various layers may be, the number of plies is uneven, with one ply 60, of whatever thickness, being a central ply bisected by the neutral axis. Central ply 60 is sandwiched by two matching adjacent plies 62, 64, commonly oriented at right angles to central ply 60. Those two plies may be sandwiched or bracketed by an additional two layers or plies 66, 68 having a predominant grain direction at right angles to the preceding layer, and so on. Five, seven, or nine layers may be typical. Some layers may be made of flake, such as poplar flake. Prior to assembly the various plies or layers may be cut from material of a known substantially uniform moisture content. The wood may be dried. That is, the moisture content of the wood layers may corresponding to the moisture content of kiln dried wood, being typically in the range of 8% to 12% by weight. This 8% to 12% range may also be the range of moisture content in the final core product as assembled. The overall matrix may also be dried and of substantially uniform moisture content prior to the addition of the veneer skins. The outermost layers of this sandwich may be of the same species to ensure that the layers have the same properties in terms of moisture absorption. To the extent that core 22 is sanded to a specified thickness, that sanding may be evenly matched from top and bottom surfaces to retain the balance of structural properties. It may be that all of the plywood layers are made of the same species.

The veneer skins may also be of matching properties in terms of moisture absorption and drying, which, in practical terms may tend to mean that it is of matching wood species or type. That is, whether the veneer is red oak, white oak, maple, cherry, walnut, or some other natural grain hardwood suitable for flooring, the type of wood of both layers is the same, and the predominant direction of the grain of the top and bottom veneer layers is also aligned to run in substantially the same direction, that direction being, typically, the cross-wise or y-direction. To the extent that these layers are subject to post-gluing processing or finishing, such as sanding or provision of a surface treatment, that post-processing may apply equally to both top and bottom surfaces. That is, the method of construction includes matching the structure above the neutral axis to the structure below the neutral axis, such that the physical properties of the structure above and below the neutral axis are balanced.

After construction of the core matrix, and the addition of the veneer surfaces, the core may be prepared for receiving the edge members. Considering the first edge member along the rear of the false tread, the tongue is formed on the non-showing edge, a groove is formed on the non-showing hardwood edge member, and the two are mated together. If there is more than one non-showing edge member, the edge member along the longest side is mounted first, as shown in FIG. 1*c*. This subassembly is then milled again on both ends to provide a tongue for mating engagement with the grooves formed in the respective side pieces, and along the front edge to provide a tongue. The mated parts are glued together.

As may be appreciated, the un-nosed edges are of substantially identical through thickness to the overall thickness of the core, if overlain by veneer, or the core and veneer including top and bottom sheets if not overlain by veneer sheets. The nosed edges have a greater through thickness than the core-and-veneer sandwich. Considering the profile shown in FIG. 1*d*, the nosed edge members 28, 30, 32 have a bull nose portion, indicated generally as 70, and a rearward flange portion indicated generally as 72. The front edge of bull nose portion 70 has a continuously radiused curvature, which may be a radius formed on a constant center of curvature. The upper edge of the bullnose ends in a tangent portion 74 that, when installed, lies flush with the upper surface of the upper veneer member 48. The rearward face of the edge member is indicated generally as 76, and has the female out-of-plane profile formed therein, as indicated by groove 78. Face 76 continues downward defining the rearward abutment surface 80 of the nosed edge member that may then bear against, and conceal, the underlying worn stair tread overlain by core member 22. In typical use, surface 80 may tend to lie in a vertical plane. The forward face of flange portion 72 may have features such as a radiused cove 82 and a shoulder 84. The vertical through thickness of bullnose portion 70 is indicated as $t_{70}$. This thickness is greater than the through thickness $t_{22}$ of core 22. For example, where core 22 may be roughly ¾" in overall thickness, bullnose portion 70 may be roughly an inch or more in thickness. Flange portion 72 may or course extend rather further, such that overall depth $t_{28}$ may approach 2" in depth, being greater than twice the depth of bullnose portion 70.

It need not be that one side of the false stair tread assembly have an un-nosed edge, while three other sides have nosed edge members. In FIGS. 2*a*, 2*b* and 2*c*, for example, a false stair tread 120 (which is in other respects substantially the same as false stair tread assembly 20) is shown in which there is a core 122 surrounded are three un-nosed edge members, 126, 128, and 130, being the rear and two short side edge members, and a single nosed edge member 132 running along the remaining long side defining the front or leading edge of the stair tread assembly. Generically, the step has four edges, and the number of nosed and un-nosed edge members add up to four, whether it is 1:3, 2:2, or 3:1, or possibly 4:0 where the entire stair edge is exposed to view. In each case, the un-nosed edge members may be made of second grade, or "B" grade hardwood and overlain by matching veneer, such as continuous sheets of layers 48, 50, or by strips strips, such as items 86 and 88.

Similarly, it need not be that the upper and lower veneer surfaces, 48 and 50 are made of continuous monolithic sheets as if the main body of the tread were made from a single piece of hardwood. Rather, as suggested in FIG. 3, those veneer surfaces may be made of parallel strips 90, 92, 94, 96 as if the step were a laminate of lengthwise running boards. Of course, surfaces 48 and 50 are then made of matching strips, and those strips may tend to be aligned cross-wise to the next underlying layer of plywood.

As shown in FIG. 3, the resultant assembly may sit on an existing stair tread, A20, with core 22 (or 122) and rear edge member 26 (or 126) overlying existing stair tread member A22. Rear edge member 26 (or 126, as may be) abutting the existing upwardly extending riser A24. Flange 72 depends in front of, and may abut the trimmed edge of former stair tread A20, the former stair bullnose A26 (shown in phantom) having been trimmed flush with the original riser A24. Alternatively, a riser cap 136 (i.e., a false facing to cover the original riser face) may cover the original riser, and surface 80 may in that case abut the upper margin of riser cap 136 rather than original riser A24. Where riser cap 136 is not used, rear edge member 26 may be trimmed to cause the combined step-wise dimension of core 22 and rear edge member 26 to conform to the existing step dimension.

Various embodiments of the invention have been described in detail. Since changes in and or additions to the above-described best mode may be made without departing from the nature, spirit or scope of the invention, the invention is not to be limited to those details but only by the appended claims.

I claim:

1. A replacement stair tread assembly comprising:

a core member, said core member having a thickness, a stepwise depth, and a cross-wise width, said step-wise depth and said cross-wise width being greater than said thickness;

said core member being a dimensionally stabilized core member having a wood-based core matrix, said core matrix having a plurality of overlying layers, said core matrix having cross-wise variation of grain direction between successive layers, said core matrix having substantially uniform mechanical elasticity cross-wise, and said core matrix having substantially uniform mechanical elasticity step-wise;

said core matrix having an upper surface and an opposed lower surface;

said core member including at least a first wood veneer portion mounted to said upper surface of said core matrix, and a second wood veneer portion mounted to said lower surface of said core matrix, said first and second wood veneer portions lying in parallel planes and having matching material and physical properties;

said core member having a quadrilateral form when viewed looking in a direction perpendicular to said plane of said first wood veneer portion;

said core member having a periphery and an array of edge members mounted about said periphery such that said core matrix is concealed from view;

said edge members being made of solid hardwood;

said edge members including at least a first nosed edge member;

said edge members including at least a first un-nosed edge member;

said core member having a first edge portion for mating engagement with said first un-nosed edge member, said first edge portion having a first profile machined along at least a first portion thereof;

said first un-nosed edge member having a second profile machined therealong;

said first profile including an out-of-plane feature;

said second profile including an out-of-plane feature;

said first and second profiles being mutually mating profiles;

said first un-nosed edge member having a through thickness matching said core member such that when said first and second profiles are mated said first un-nosed edge member mates flush with said first wood veneer portion of said core member;

said core member having a second edge portion for mating engagement with said first nosed edge member, said second edge portion having a third profile;

said first nosed edge member having a fourth profile machined therealong;

said third and fourth profiles being mutually mating profiles such that when mated together said first nosed edge member having a first nosing, said first nosing being flush with said first wood veneer portion of said core member; and said first nosing having an overall height greater than said thickness of said core member.

2. The replacement stair tread assembly of claim 1 wherein said first edge portion is oriented cross-wise to said second edge portion, said second edge portion has a first end; and said third profile is cut across said first end of said second edge portion, said first edge portion having an end region mated to said first end of said second edge portion.

3. The replacement stair tread assembly of claim 1 wherein said first nosing includes a bullnose, and said bullnose has a through thickness greater than said thickness of said core member.

4. The replacement stair tread assembly of claim 3 wherein said first nosing includes a depending edge located stepwise inwardly of said bullnose, said depending edge having a rearward facing abutment surface for engaging an existing stair.

5. The replacement stair tread assembly of claim 1 wherein said stair tread includes four edge members in a set, the set including any one of:

(a) first, second and third nosed edge members and said first un-nosed edge member;

(b) first and second nosed edge members and first and second un-nosed edge members; and (c) said first nosed edge member and first, second and third un-nosed edge members.

6. The replacement stair tread assembly of claim 1 wherein said core matrix is a plywood matrix.

7. The replacement stair tread assembly of claim 1 wherein said hardwood is selected from the group consisting of (a) red oak; (b) white oak; (c) maple; (d) walnut; and (e) cherry.

8. The replacement stair tread assembly of claim 1 wherein said core member has a through thickness of less than ¾ inches.

9. The replacement stair tread assembly of claim 8 wherein said first nosed edge member includes a bullnose, and said bullnose has a through thickness of at least 1 inch.

10. The replacement stair tread assembly of claim 9 wherein said core member is substantially rectangular and has a pair of long edges and a pair of short edges; said first un-nosed edge member extends along one of said long edges; and, when assembled, said core member and said first un-nosed edge member, taken together, have an overall dimension step-wise of at least 7½".

11. The replacement stair tread assembly of claim 10 wherein said bullnose has a depending flange, and said depending flange has a rearwardly facing abutment surface for engagement of an existing stair, said rearwardly facing abutment surface extending in a plane flush with a forward edge of said first wood veneer portion.

12. The replacement stair tread assembly of claim 1 wherein said first profile is a tongue and said second profile is a mating groove.

13. The replacement stair tread assembly of claim 1 wherein said third profile is a tongue and said fourth profile is a mating groove.

14. The replacement stair tread of claim 1 where said first and third profile are the same, and said second and fourth profiles are the same.

* * * * *